United States Patent [19]

Therkelsen

[11] Patent Number: 5,076,649

[45] Date of Patent: Dec. 31, 1991

[54] CABINET ASSEMBLY

[76] Inventor: Adam Therkelsen, 5103 Coral Ct., Concord, Calif. 94521

[21] Appl. No.: 597,425

[22] Filed: Oct. 15, 1990

Related U.S. Application Data

[63] Continuation-in-part of Ser. No. 524,226, May 15, 1990, abandoned.

[51] Int. Cl.[5] ..... A47B 88/00

[52] U.S. Cl. ..... 312/246; 312/319

[58] Field of Search ..... 312/307, 312, 266, 247, 312/341.1, 246, 319; 248/911

[56] References Cited

U.S. PATENT DOCUMENTS

| | | | |
|---|---|---|---|
| 255,771 | 4/1881 | Carpenter . | |
| 1,430,960 | 10/1922 | Elwert . | |
| 1,805,989 | 5/1931 | Levene | 108/167 |
| 1,879,888 | 10/1931 | Sieber et al. . | |
| 2,854,308 | 9/1958 | Harris, Jr. . | |
| 2,861,857 | 11/1958 | Lee et al. . | |
| 2,875,012 | 2/1959 | Riley . | |
| 2,944,540 | 7/1960 | Littell, Jr. . | |
| 3,028,210 | 4/1962 | Byars . | |
| 3,224,827 | 12/1965 | Foster et al. . | |
| 3,279,876 | 10/1966 | St. Cyr | 108/167 |
| 3,415,586 | 12/1968 | Hammond . | |
| 4,151,804 | 5/1979 | Waché et al. . | |
| 4,941,718 | 7/1990 | Alexander, III et al. . | |

*Primary Examiner*—Joseph Falk

*Attorney, Agent, or Firm*—Majestic, Parsons, Siebert & Hsue

[57] ABSTRACT

A cabinet assembly is provided which comprises inner and outer cabinet structures adapted so that the inner cabinet can be diagonally raised or lowered with respect to the fixed outer cabinet. Motorized means facilitate the movement of the inner cabinet; moreover, limit switch mechanisms are utilized to activate and deactivate said motor means. A latch mechanism provides additional support for the inner cabinet.

8 Claims, 3 Drawing Sheets

CABINET ASSEMBLY

This application is a continuation-in-part of Ser. No. 07/524,226, filed May 15, 1990 now abandoned.

BACKGROUND OF THE INVENTION

This invention relates to cabinet structures, and more particularly, to cabinets provided with means for diagonally raising and lowering the shelves thereof.

Maximum utility of home or office space often requires that cabinets be attached to walls and located far above ground. Not infrequently, other furniture or fixtures are situated on the floor below the cabinets. For instance, cupboards are oftentimes places above kitchen appliances to maximize the use of kitchen space. However, difficult-to-reach cabinets and storage racks pose access problems.

An object of this invention is to provide a cabinet structure wherein the shelves can be raised and lowered diagonally for convenient access thereto and wherein the movement of the shelves does not interfere with furniture located just below the cabinet.

Another object of this invention is to provide an improved shelf raising and lowering device which is adapted to be electrically energized.

SUMMARY OF THE INVENTION

In one embodiment of the invention, a cabinet assembly is provided which comprises an outer cabinet structure adapted for wall mounting and an inner cabinet structure that is adapted to fit into said outer cabinet. The inner cabinet is movably attached to the outer cabinet by slides. The position of the slides is adjustable so that the angle at which the inner cabinet moves with respect to the fixed outer cabinet can be changed. This angle generally ranges from 0 to 35 degrees, where at 0 degree the inner cabinet moves horizontally with respect to the outer structure.

The embodiment also comprises motorized means to facilitate the raising and lowering of the inner cabinet. In addition, limit switch mechanisms are used to activate and deactivate the motor. Furthermore, a latch mechanism may be used to provide additional support for the inner cabinet.

In one preferred embodiment of the invention, the inner cabinet is raised and lowered with respect to the outer cabinet by a cable. One end of the cable is attached to the inner cabinet while the other end is attached to a motor that is affixed to the outer cabinet. Depending on whether the motor is operating in the forward or reverse mode, the cable is wound or unwound, thereby raising or lowering the inner cabinet.

In another preferred embodiment, a screw jack mechanism (instead of a cable system) is utilized to raise and lower the inner cabinet.

DETAILED DESCRIPTION OF THE INVENTION

Figure 1:
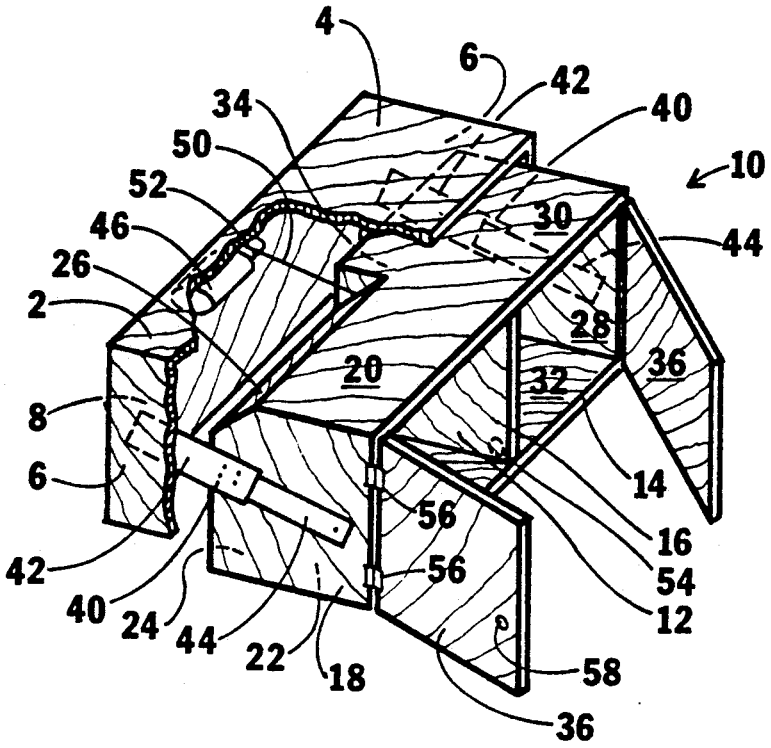
FIG. 1 is a top quarter isometric view of a preferred embodiment of the invention.

FIG. 1 is an isometric view of a preferred embodiment of the invention. As shown, the invention comprises an outer cabinet structure 2 that can be mounted on a wall and that comprises top panel 4, side panels 6, and back panel 8. The cabinet structure 2 does not contain a front or bottom panel. The dimensions of this cabinet structure are comparable to those commonly used in the home or office. The structure can be made of wood, metal, hard plastic or any other suitable materials.

Positioned partially inside outer cabinet 2 is inner cabinet 10 which comprises two compartments, a left compartment 12 and a right compartment 14, that are separated by dividing panel 16. With regard to left compartment 12, it consists of side panel 18, top panel 20, bottom panel 22, lower back panel 24 and upper back panel 26. Similarly, right compartment 14 consists of side panel 28, top panel 30, bottom panel 32, and back panel 34. Each compartment has a cabinet door 36 that is mounted on hinges 56 and is equipped with a doorknob 58. For smaller size cabinets, it may be preferable to have just one cabinet door.

The left and right compartments are identical except that because a motor (described below) is situated behind the upper portion of the left compartment, less room is available for the left compartment. Each compartment can be further divided by the addition of shelves.

The inner cabinet 10 is movably attached to outer cabinet 2 by slide 40. As will be discussed below, the slides are attached to indentations in the panels of the inner and outer cabinets. Each slide comprises an outer rail 42 that is attached to side panels 6 of the outer cabinet and an inner rail 44 that is attached to side panels 18 and 28 of the left compartment and right compartment, respectively. Each outer rail 42 is provided with grooves on the inside thereof for receiving the outer rail 42 which is contoured to allow the inner and outer rails to slide along each other. The rails thus allow inner cabinet 10 to move in and out of outer cabinet 2. Moreover, the length of the rails determines how far the outer cabinet can be lowered.

The position of the slide 40 is adjustable so that the angle at which the inner cabinet moves with respect to the fixed outer cabinet can be changed. This angle generally ranges from 0 to 35 degrees, where at 0 degree, the inner compartment moves horizontally with respect to the outer cabinet. Shown in FIG. 3A is side panel 18 of the left compartment and left side panel 6 of the outer panel. Depicted collectively as 250 is an array or set of indentations on the same surface of panel 6 to which slide 40 is attached. Similarly, depicted collectively as 255 is an array of indentations on the same surface of panel 18 to which slide 40 is attached. Conventional means (not shown) on slide 40 allows the slide to be attached to the indentations on panels 6 and 18. Attachment of slide 40 to one indentation on each panel is sufficient to support the inner cabinet. The indentations can be reinforced by conventionals for "heavy duty" applications. By attaching slide 40 to the appropriate indentations in arrays 250 and 255, the direction (e.g., angle) at which the inner cabinet moves with respect to the outer cabinet can be readily adjusted. Instead of indentations, holes can be used. Stop means (not shown) situated in slide 40 prevent rails 42 and 44 from disengaging from each other when the inner cabinet is at the fully extended position.

A conventional reversing fractional horsepower motor with speed reducing gearing 46 is provided to raise and lower the inner cabinet. An output shaft (not shown) is provided to rotate at about 40 rpm. The shaft is attached to roller 48 which in turn is attached to cable 50. The cable is wound on roller 52 when the roller is driven by the motor 46. The other end of cable 50 is connected to dividing wall 16 so that as the cable is wound, the inner cabinet 10 is raised toward outer cabinet 2. To lower the inner cabinet, the cable is unwound from the roller when the motor 46 is operating in reverse.

Figure 2:
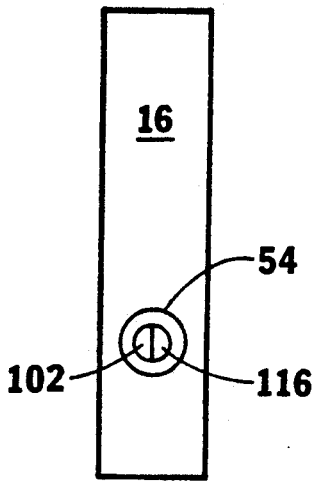
FIG. 2 is a front elevation view of the dividing panel.

A limit switch 54 is positioned at the dividing panel 16 and is provided with two actuating members 102 and 116, as shown in FIG. 2. The actuating members 102 and 116 are adapted to be engaged by the left and right cabinet doors, respectively. Assuming the inner cabinet to be in its uppermost position with both doors closed, the opening of either or both doors engaged actuating members 102 and/or 116. This in turn opens switch 54, thereby causing the gear motor 46 to rotate counterclockwise to allow gravity to move inner cabinet 10 out from the outer cabinet 2 at gear motor speed. The distance the inner cabinet traverses depends upon the size of the cabinet, the length of the slides, and the angle at which the slides are positioned. It is contemplated that the vertical distance between top panel 4 of the outer cabinet and top panel 20 of the left compartment will be approximately one foot when the inner cabinet is fully extended. As will be described below, when the inner cabinet is in the extended position, a lower limit switch is activated to deenergize motor 46.

Figure 3B:
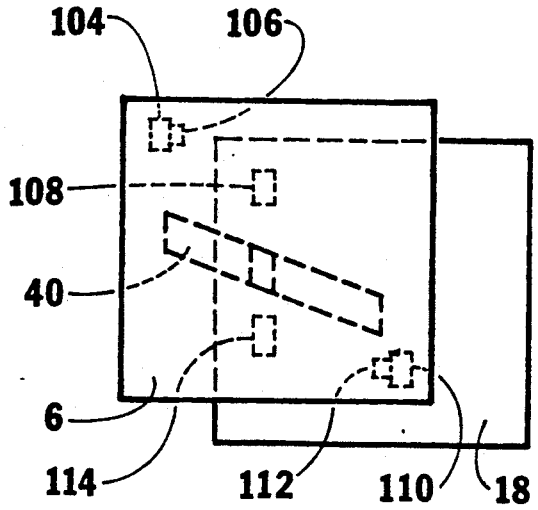
FIG. 3B is a side elevation view of the side panels of the inner and outer cabinet structures.
Figure 3A:
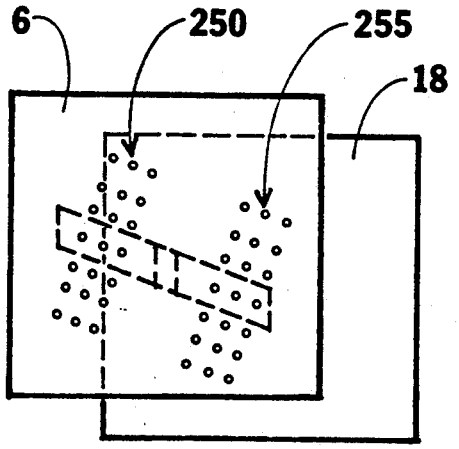
FIG. 3A is a side elevation view of the side panels of the inner and outer cabinet structures with indentation arrays therein.

As shown in FIG. 3, situated on side panel 18 of the left compartment and on left side panel 6 of the outer cabinet are lower and upper limit switches and contact members that activate the switches. Specifically, upper limit switch 104 and its actuating member 106 are affixed onto the upper left corner of left side panel 6; similarly, lower limit switch 110 and its actuating member 112 are affixed onto the lower right corner of left side panel 6. Contact members 108 and 114 are affixed onto side panel 18 of left compartment 18 so that when the inner cabinet is in the stowed position, contact member 108 physically engages and activates switch 104. Similarly, when the inner cabinet is in the extended position, contact member 114 activates switch 110. Activation of either switch 104 or 110 deenergizes motor 46.

In order to raise the inner cabinet 10 from its extended position, both cabinet doors are closed to thereby cause limit switch 54 to be closed. The gear motor 46 reverses and draws the inner cabinet 10 upwards. When contact member 108 reaches and activates switch 104, motor 46 is deenergized, and the inner cabinet stops its ascent and comes to rest in its stowed position. In this embodiment, the switch mechanism can be designed so that the upward motion of the inner cabinet stops when one or both cabinet door is opened.

Instead of the switch mechanism illustrated in FIG. 3 wherein the switches are designed to be activated or deactivated when the inner cabinet is either in the stowed or extended position, the switch mechanism employed can be such that the inner cabinet can be raised or lowered to any position between the stowed or fully extended position. For instance, a mechanism using a toggle switch can be employed for this purpose.

Figure 4:
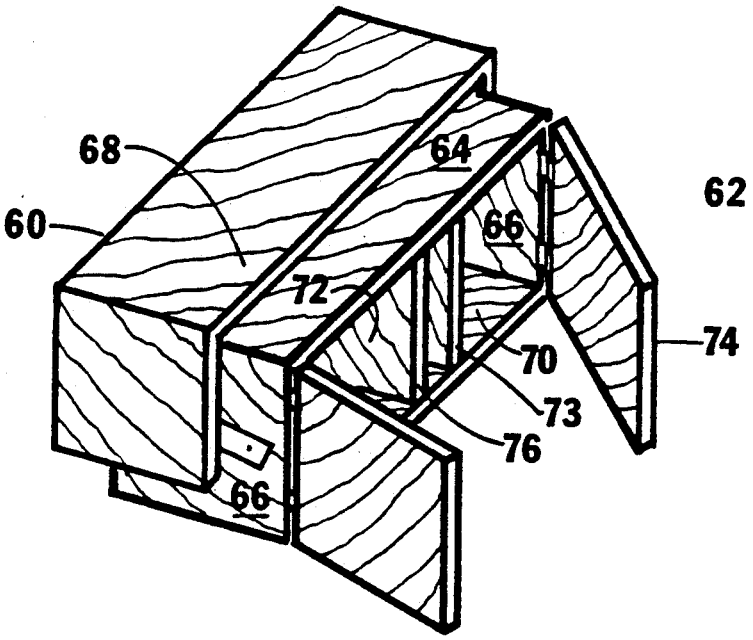
FIG. 4 is a top quarter isometric view of the inner and outer cabinets of another embodiment of the invention which employs a screw jack mechanism.

FIG. 4 is a top quarter isometric view of the inner and outer cabinets of another embodiment of the invention which employs a screw jack mechanism (not shown) to facilitate movement of the inner cabinet. As shown, an outer cabinet 60 similar to the one depicted in FIG. 1 encloses an inner cabinet 62 which comprises top panel 64, side panels 66, back panel 68 and bottom panel 70. The inner cabinet 62 is further divided into two identical compartments, left compartment 72 and right compartment 74, by partitions 76 and 78, respectively. The inner cabinet 62 is attached to the outer cabinet 60 by the same slide mechanism as depicted in FIG. 1 and described above.

Figure 5:
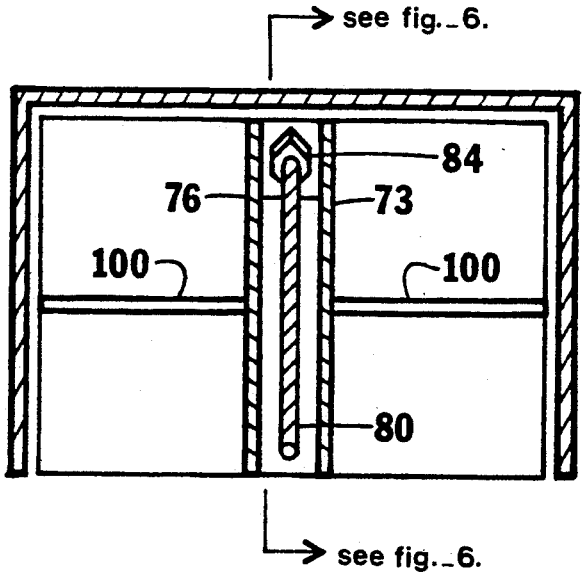
FIG. 5 is the front elevation view of the inner and outer cabinets.
Figure 6:
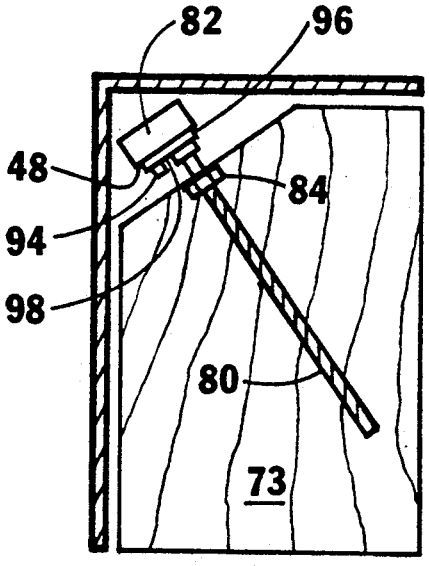
FIG. 6 is a side elevation view in partial cross-section taken substantially along line 6—6 of FIG. 5.

FIG. 5 is the front elevation view of outer cabinet 60 and inner cabinet 62 (without the doors) and FIG. 6 is a sectional view thereof. As shown in FIGS. 5 and 6, a diagonally disposed rotatable screw 80 is positioned in the space between partitions 76 and 78. A conventional reversible fractional horsepower motor with speed reducing gearing 82 is positioned in the upper-inner corner of outer cabinet 60. Motor shaft 48, disposed parallel to screw 80, is attached to a pulley 94 that is, in turn, connected to a second pulley 96 by a drive-belt 98. The second pulley is attached to rotatable screw 80 so that rotational movement from motor 82 can be transmitted to screw 80. Threadedly mounted upon screw 80 is nut 84, the nut being restrained from rotational movement and affixed to diagonal wall 116 of inner cabinet 62. As screw 80 is rotated by the motor, it imparts axial movement to the inner cabinet, thereby either elevating or lowering the inner cabinet depending on whether the motor is rotating in forward or in reverse Also shown are shelves 100; more shelves can be added as needed.

The inner cabinet of this embodiment can be equipped with doors that are adapted to activate motor 82. Furthermore, the limit switch mechanisms for the preferred embodiment as shown in FIGS. 1 through 4 and described above can be adapted for use in the screw jack embodiment. Alternately, a manually operated switch (not shown) can be utilized. For example, a push-button switch that, when engaged, causes motor 82 (and screw 80) to rotate, thereby lowering the inner cabinet can be used. Conversely, to raise the inner cabinet from its extended position, said switch is manually closed, thereby causing motor 82 to rotate in reverse into the stowed position and stop. The distance the inner cabinet traverses depends upon the size of the cabinet, the length of the slides, the angle at which the slides are positioned, and the length of the screw.

Figure 7:
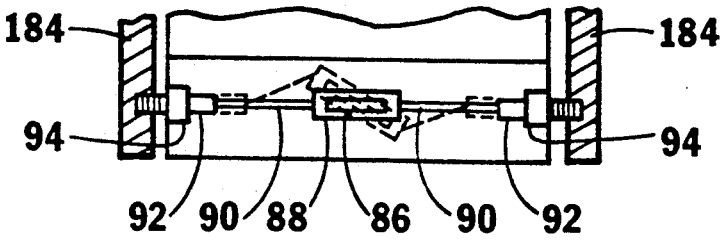
FIG. 7 is a front elevation view of a latch mechanism.

An optional latch mechanism can be used as additional support for the inner cabinet in its stowed position. The latch mechanism would be located below the bottom panel of the inner cabinet. As shown in a partially exposed view of the mechanism in FIG. 7, the latch mechanism comprises handle 86 which is pivotally attached to inner member 88. The inner member 88 is connected by wires 90 to bolts 92. In the stowed position, the inner member is positioned perpendicular to panels 184 so that the outermost portions of the bolts extend into accommodating bores in outer side panels 184. The bolts provide additional support to the inner cabinet 62 which is especially important when the inner cabinet is filled with heavy items. Not shown is a spring-loading mechanism which causes bolts 92 to be extended into the accommodating bores. Turning handle 86 rotates inner member 88, thereby causing the bolts 92 to retract from outer side panel 184. Not shown is a locking mechanism which locks the bolts into their retracted position. Support members 94 help keep the bolts aligned with the accommodating bores in panels 84. The latch mechanism is normally enclosed by bottom and front protective coverings so that only handle 86 is exposed. When the bolts are in the retracted position, the inner cabinet may be lowered from its stowed position.

In the above description, the mechanism by which the motor is activated and deactivated to raise and lower the inner cabinet requires a series of switches. Moreover, sensors in the cabinet assembly are needed to drive the requisite logic circuits. The design of the electrical circuit is within the skill of one in the electrical arts, and will not be described herein.

In the above described embodiments, reversible motors are used. However, often with AC current, the use of non-reversible motors is more practical. When non-reversible motors are used, direction reversal means such as gears must be incorporated in order that the inner cabinet can be raised and lowered.

Figure 8:
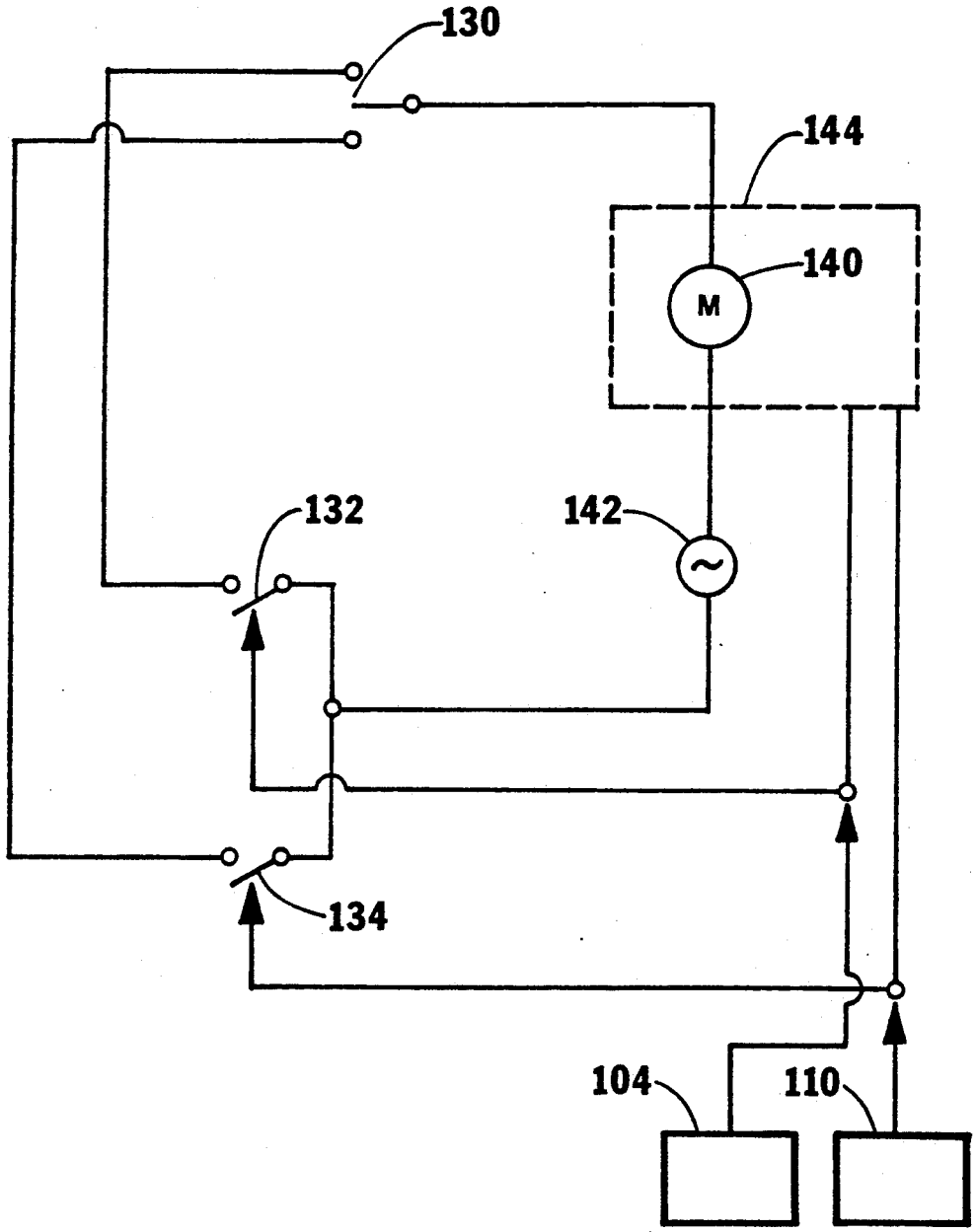
FIG. 8 is a diagram of electrical connections employed in a preferred embodiment of the invention.

Furthermore, as an alternative to the mechanism described above to activate and deactivate the motor, a less complex means can be employed. FIG. 8 is a diagram of electrical connections that can be employed in both the screw jack and cable system embodiments. As an illustration as to how the circuitry in FIG. 8 operates, assume that the inner cabinet of an embodiment of the invention is in the stowed position and that limits switches as shown in FIG. 3 are present. In this position, contact member 108 is physically engaging actuating member 106 of limit switch 104. The throw switch 132 is closed and throw switch 134 is open. Moreover, signals from limit switch 104 cause direction reversal means 144 to be in the lowering mode. If throw switch 130 is then placed in the upper position, motor 140 is activated and driven by power source 142 to cause the inner cabinet to descend until contact member 114 engaged actuating member 112 of lower limit switch 110. When so engaged, throw switch 132 becomes open, and signals from limit switch 110 cause direction reversal means 144 to be repositioned to the mode for raising the inner cabinet. At this point, in order to raise the inner cabinet, throw switch 130 is placed in the lower position thereby activating motor 140, which causes the inner cabinet to be raised until contact member 108 engages actuating member 104 of limit switch 106. The signal from limit switch 104 opens throw switch 134 to stop the motor and also causes the direction reversal means 144 to change modes. The inner cabinet is now in the original stowed position.

It is to be understood that while the invention has been described above in conjunction with preferred specific embodiments, the description and examples are intended to illustrate and not limit the scope of the invention, which is defined by the scope of the appended claims.

It is claimed:

1. A cabinet structure that can be raised and lowered diagonally, which comprises:

(a) an outer cabinet adapted for attachment to a wall and that has no bottom or front panel;

(b) an inner cabinet sized so as to be receivable within said outer cabinet;

(c) means for connecting said inner cabinet to said outer cabinet which permit said inner cabinet to move along a defined path with respect to said outer cabinet;

(d) means for adjusting the defined path so that the direction in which the inner cabinet moves with respect to the outer cabinet can be adjusted; and (e) raising and lowering means for moving said inner cabinet with respect to said outer cabinet along any defined path.

2. A cabinet structure as defined in claim 1 further comprising means for activating said raising and lowering means.

3. The cabinet structure of claim 2 wherein said raising and lowering means comprise a motor.

4. The cabinet structure of claim 3 further comprising means for stopping the cabinet at any position along said defined path.

5. The cabinet structure of claim 3 wherein said raising and lowering means further comprise a cable having a pair of opposite ends, one end being operatively connected to a pulley on said motor and the other end being connected to said inner cabinet whereby said inner cabinet may be raised or lowered by means of said motor extending or retracting said cable.

6. The cabinet structure of claim 3 wherein said raising and lowering means further comprises a threaded screw jack having a pair of opposite ends, one end being operatively connected to said motor and the body of the screw jack being operatively connected to an internally threaded nut affixed to said inner cabinet whereby rotation of said screw jack in opposite directions by means of said motor causes said inner cabinet to be raised or lowered.

7. The cabinet structure of claim 1 further including latching means for releasably securing said inner cabinet to said outer cabinet for additional support.

8. The cabinet structure of claim 6 wherein said latching means comprises bolt means on said inner cabinet and means for selectively moving said bolt means so as to be in engagement with accommodating bores in said outer cabinet.

* * * * *